US012474124B2

(12) United States Patent
Dall'Olio et al.

(10) Patent No.: US 12,474,124 B2
(45) Date of Patent: Nov. 18, 2025

(54) PLATE FOR HEAT EXCHANGER AND HEAT EXCHANGER WITH SUCH PLATE

(71) Applicant: VERTIV S.R.L., Piove di Sacco (IT)

(72) Inventors: Roberto Dall'Olio, Bologna (IT); Andrea Parise, Padua (IT)

(73) Assignee: Vertiv S.R.L., Piove di Sacco (IT)

( * ) Notice: Subject to any disclaimer, the term of this patent is extended or adjusted under 35 U.S.C. 154(b) by 342 days.

(21) Appl. No.: 18/030,358

(22) PCT Filed: Oct. 5, 2021

(86) PCT No.: PCT/EP2021/077450
§ 371 (c)(1),
(2) Date: Apr. 5, 2023

(87) PCT Pub. No.: WO2022/074005
PCT Pub. Date: Apr. 14, 2022

(65) Prior Publication Data

US 2023/0375275 A1 Nov. 23, 2023

(30) Foreign Application Priority Data

Oct. 6, 2020 (IT) ..... 102020000023473
Sep. 9, 2021 (IT) ..... 102021000023270

(51) Int. Cl.
*F28D 9/00* (2006.01)
*F28F 3/08* (2006.01)
*F28F 21/06* (2006.01)

(52) U.S. Cl.
CPC ..... *F28D 9/0037* (2013.01); *F28F 3/086* (2013.01); *F28F 21/065* (2013.01); (Continued)

(58) Field of Classification Search
CPC ..... F28D 9/0031; F28D 9/0037; F28F 3/046; F28F 3/044; F28F 3/086; F28F 21/065
See application file for complete search history.

(56) References Cited

U.S. PATENT DOCUMENTS 3,963,810 A 6/1976 Holmberg et al.
4,384,611 A 5/1983 Fung
(Continued)

FOREIGN PATENT DOCUMENTS

EP 0 865 598 B1 9/1998
EP 2645039 B1 12/2017
(Continued)

OTHER PUBLICATIONS

Australian Examination Report dated Jul. 26, 2024 received in Australian Application No. 2021358391.
(Continued)

*Primary Examiner* — Jianying C Atkisson
*Assistant Examiner* — For K Ling
(74) *Attorney, Agent, or Firm* — Sulter Swantz IP

(57) ABSTRACT

A plate for a heat exchanger, which comprises a plurality of unit cells, each one of the unit cells comprising a first face and a second face which is opposite the first face, the first face and the second face having a plurality of spacers which are arranged so as to produce mutually perpendicular directions of flow between the first face and the second face. The spacers differ between the first face and the second face in terms of number and/or shape and/or size.

23 Claims, 9 Drawing Sheets

(52) U.S. Cl.
CPC ..... *F28F 21/067* (2013.01); *F28F 2210/10* (2013.01); *F28F 2240/00* (2013.01)

(56) References Cited

U.S. PATENT DOCUMENTS

| | | | | | |
|---|---|---|---|---|---|
| 4,915,165 | A * | 4/1990 | Dahlgren | F28F 3/046 | 165/166 |
| 4,971,137 | A * | 11/1990 | Thompson | F28F 27/02 | 165/300 |
| 6,648,067 | B1 * | 11/2003 | Maute | F28D 9/0037 | 165/905 |
| 7,328,886 | B2 * | 2/2008 | Mockry | F28F 25/00 | 165/DIG. 185 |
| 10,914,532 | B2 * | 2/2021 | Kim | F28D 21/0007 | |
| 2004/0080060 | A1 * | 4/2004 | Mockry | F28D 9/0037 | 261/153 |
| 2009/0032232 | A1 * | 2/2009 | Murayama | F28D 9/0037 | 29/890.03 |
| 2013/0113126 | A1 * | 5/2013 | Mockry | F28F 25/08 | 165/104.34 |
| 2013/0299146 | A1 * | 11/2013 | Blomgren | F28F 3/046 | 165/166 |

FOREIGN PATENT DOCUMENTS

| | | | |
|---|---|---|---|
| EP | 3413003 | A1 | 12/2018 |
| WO | 97/21062 | A1 | 6/1997 |
| WO | 2012/166750 | A1 | 12/2012 |

OTHER PUBLICATIONS

International Search Report dated Jan. 24, 2022 issued in PCT/EP2021/077450.
Written Opinion dated Jan. 24, 2022 issued in PCT/EP2021/077450.
Italian Search Report and Written Opinion dated May 20, 2021 issued in IT 202000023473, with partial translation.

* cited by examiner

PLATE FOR HEAT EXCHANGER AND HEAT EXCHANGER WITH SUCH PLATE

CROSS-REFERENCE TO RELATED APPLICATIONS

The disclosures in Italian Patent Applications No. 102020000023473 and No. 102021000023270 from which this application claims priority are incorporated herein by reference.

TECHNICAL FIELD

The present invention relates to a plate for a heat exchanger.

The invention also relates to a heat exchanger with such a plate.

BACKGROUND

Heat exchangers are devices that are adapted to transfer heat between two different fluids that circulate at different temperatures.

Nowadays, for conditioning the air in enclosed environments, such as for example offices, machine rooms or data centers, various types of heat exchangers are employed.

Among these are plate heat exchangers.

EP2645039B1 in the name of the company Heatex AB contains the teachings to provide plates that have a plurality of protrusions, which constitute the spacers, which are made in a single piece with the plates themselves, via molding.

This known art has a number of drawbacks if materials are used that have a low Young's modulus and there is a high pressure difference between the two faces of the surface.

The plates taught in EP2645039B1 are preferably made of aluminum, of stainless steel or plastic material, and have protrusions that form a series of channels.

On each side of the plate there are parallel channels and the channels of one side are arranged in a direction at right angles to that of the channels arranged on the other side of the plate.

During use of the plate, one of the two sides is in contact with the hot fluid, while the other side is in contact with the cold fluid.

To reduce the risk of contamination of the hot fluid with the cold fluid and to increase the enthalpy of the hot side, fans are placed on the hot fluid side, upstream of the hot side, and fans for the cold fluid are placed downstream of the cold side.

This creates a strong pressure difference on the two faces of the exchanger: the cold side is always in a partial vacuum, and the hot side is always under pressure.

As a consequence there is a deformation of the plate, and therefore a change in its geometry, thus compromising the regular outflow of cold fluid, with an uncontrolled increase in flow resistances.

This drawback is most felt with plates made of plastic material or other materials with a low Young's modulus.

The aim of the present invention is to provide a plate for a heat exchanger and an exchanger with such plate that are capable of improving the known art in one or more of the above-mentioned aspects.

SUMMARY

Within this aim, an object of the invention is to provide a plate for a heat exchanger wherein the pressure difference between the hot side and the cold side does not result in a deformation thereof, and/or results in minor deformation, even if the plate is made of materials with a low Young's modulus.

Another object of the invention is to provide a plate for a heat exchanger that is made of materials with a low Young's modulus, with optimization of the heat exchange characteristics and of the flow resistances.

Another object of the invention is to provide a heat exchanger with a plate that is capable of achieving the above-mentioned objects.

A further object of the present invention is to overcome the drawbacks of the background art in a manner that is alternative to any existing solutions.

Another object of the invention is to provide a plate for a heat exchanger and an exchanger with such a plate that are highly reliable, easy to implement and low-cost.

This aim and these and other objects which will become more apparent hereinafter are achieved by a plate for a heat exchanger, which comprises a plurality of unit cells, each one of said unit cells comprising a first face and a second face which is opposite said first face, said first face and said second face having a plurality of spacers which are arranged so as to produce mutually perpendicular directions of flow between said first face and said second face, said plate being characterized in that said spacers differ between said first face and said second face in terms of number and/or shape and/or size.

This aim and these and other objects which will become more apparent hereinafter are also achieved by a heat exchanger of the plate type, characterized in that it comprises a plurality of plates, each one of them being a plate as previously described.

BRIEF DESCRIPTION OF THE DRAWINGS

Further characteristics and advantages of the invention will become more apparent from the detailed description that follows of a preferred, but not exclusive, embodiment of the plate for an exchanger and of the exchanger, according to the invention, which are illustrated by way of non-limiting example in the accompanying drawings, wherein.

DETAILED DESCRIPTION

Figure 1:
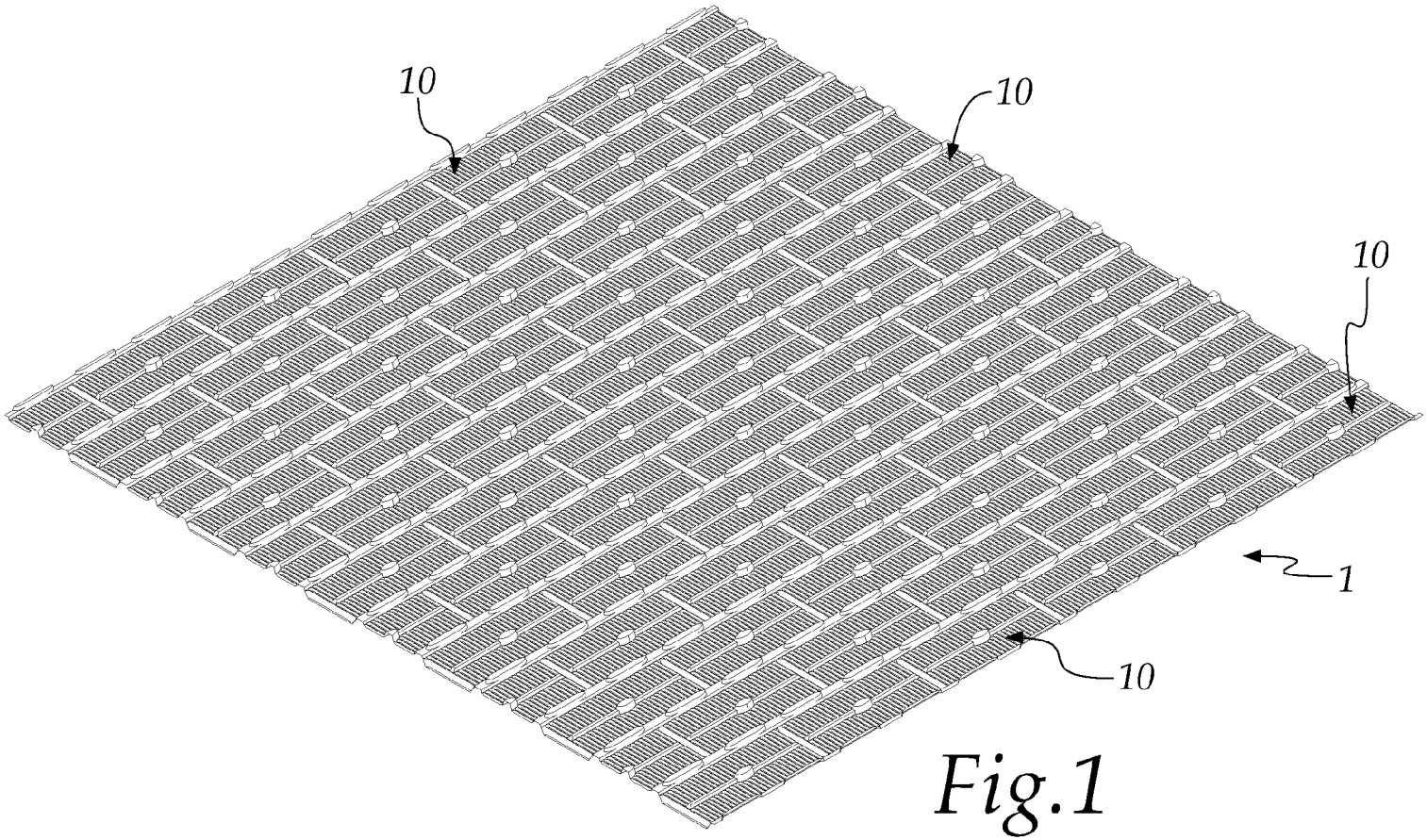
FIG. 1 is an overall perspective view of a plate according to the invention.

Plate heat exchangers have a series of mutually parallel plates, which are normally made of metallic material. These plates define, in pairs, alternating passage chambers for a hot fluid or for a cold fluid (hot air and cold air).

In the present description, the term "hot fluid" means a fluid with an enthalpy content higher than that of the fluid defined as a "cold fluid".

Similarly, in the present description, the term "cold fluid" means a fluid with an enthalpy content lower than that of the fluid defined as a "hot fluid".

As a consequence, each plate has one side in contact with the cold fluid and the other side in contact with the hot fluid.

Generally, the plates of plate heat exchangers have corrugated surfaces. In this regard, the corrugation of the surfaces makes it possible to increase the area of heat exchange and the turbulence. Such plates may be separated by spacers, which are adapted to keep them at a constant and preset distance. These spacers can be separated from the plates, and made for example of rubber or other plastic material, or in a single piece with the plates, and constituted by protrusions formed directly on them. It is contemplated herein that plates that have spacers in a single piece are simpler, quicker and cheaper to make. In fact, the spacers may be made during the molding of the plate or, at most, with a subsequent molding and they do not have to be made separately and then associated with the plates.

With reference to the figures, a plate for a heat exchanger, according to the invention, is generally designated by the reference numeral 1.

This plate 1 comprises a plurality of unit cells 10.

Figure 1A:
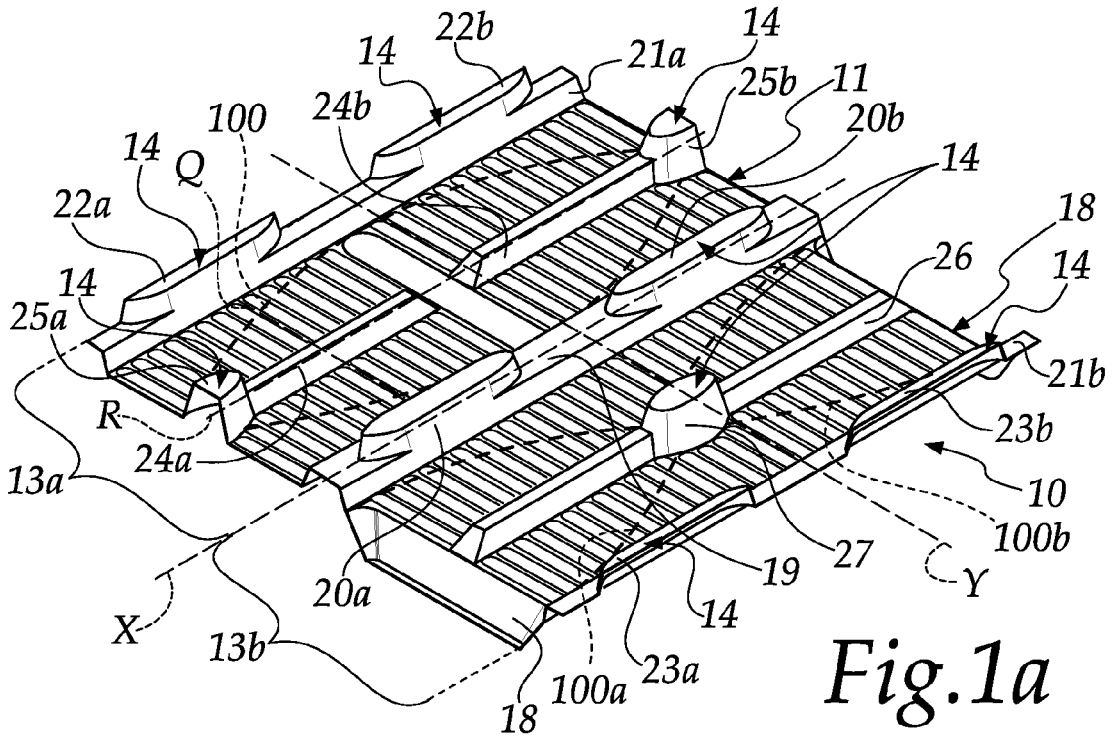
FIG. 1*a* is a perspective view of a first side of a portion of the plate of FIG. 1.
Figure 1B:
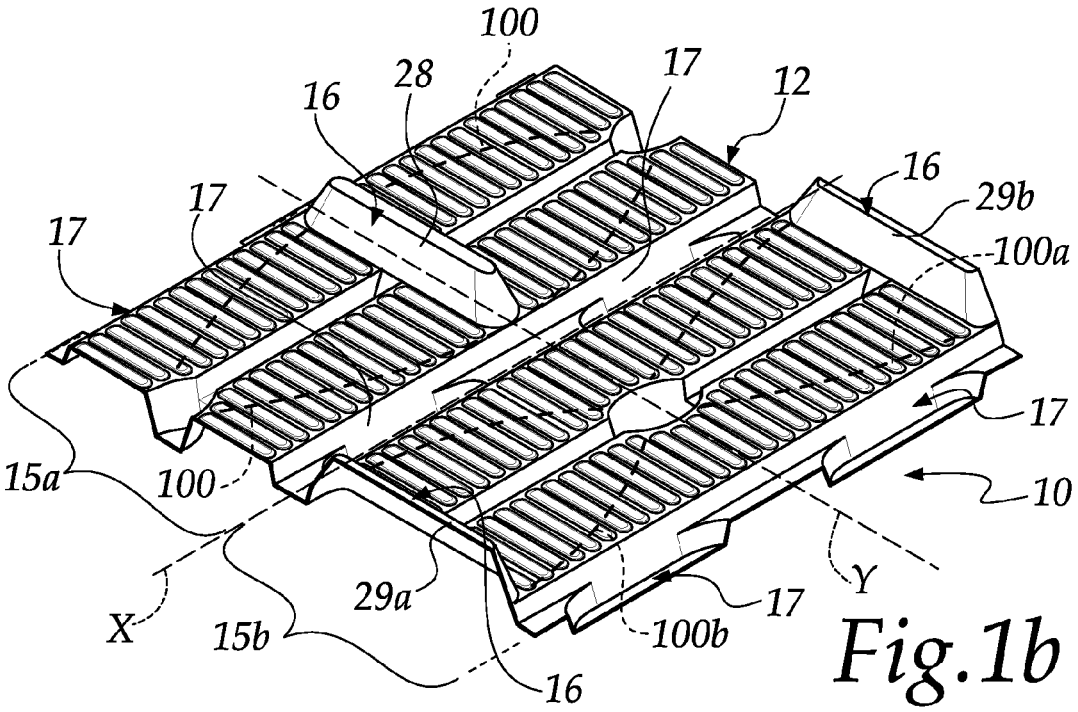
FIG. 1*b* is a perspective view of a second side, opposite the previous side, of the portion of FIG. 1*a;*

In particular, in order to make the details of the plate 1 clearly visible, FIGS. 1*a* and 1*b* show a unit cell 10 of the plate 1, which when replicated lengthwise and widthwise forms a plate 1 for a heat exchanger 30.

This unit cell 10 has a quadrangular profile, preferably square, and comprises:

- a first face 11, shown in FIG. 1*a*, which is adapted to be in contact with the cold fluid,
- a second face 12, shown in FIG. 1*b*, which is on the side opposite to the first face 11 and is adapted to be in contact with the hot fluid.

The unit cell 10 can have, for example, a side comprised between 50 and 100 mm, while the entire plate 1 can have, for example, a side comprised between 300 mm and 1300 mm.

Each face 11, 12 of the unit cell 10 has a corrugation.

The plate 1 is made of a material with a low Young's modulus, for example plastic material, PVC, polypropylene or PET.

In the present description, the term "low Young's modulus" means of the order of magnitude of thousands of MPa.

Below is a table of possible materials of which the plate 1 is made, and

| Material | Young's modulus (MPa) |
|---|---|
| Polypropylene (PP) | 1300-1800 |
| Polyethylene (PET) | 2800-3100 |
| Polyvinyl chloride (PVC) | 1500-3000 |

Such plate 1 is made by molding, in a single molding operation.

In particular, the corrugation on the face 11 of the unit cell 10 is the reverse of the corrugation on the second face 12.

The above sentence means that a concavity on the first face 11 corresponds to a convexity on the second face 12, and vice versa.

This corrugation is adapted to increase the contact surface and the generation of turbulence in the fluid with which it is in contact, thus improving the heat exchange between the hot fluid and the cold fluid.

Each face 11, 12 has a plurality of spacers 14, 16, each one with an elevation at right angles to the surface of the respective face 11, 12.

The spacers 14, 16, are arranged so as to produce mutually perpendicular directions of flow on the two faces 11, 12.

Such spacers 14, 16, are made in a single piece with the rest of the unit cell 10 and of the plate 1, during the molding of the latter.

At each spacer 14 of the first face 11, there is a complementary cavity/shaped portion 17 on the second face 12; while at each spacer 16 of the second face 12, there is a complementary cavity/shaped portion 18 on the first face 11.

One of the particularities of the invention consists in the fact that such spacers 14, 16, differ between the first face 11 and the second face 12 in terms of number and/or shape and/or size.

In particular the spacers 14 on the first face 11 are more numerous and larger than the spacers 16 on the second face 12.

Considering a first axis X of the unit cell 10, substantially central and perpendicular to the direction of the corrugation, such first face 11 comprises two portions:

- a first portion 13*a*,
- a second portion 13*b*.

Similarly, the second face 12 comprises two portions:

- a third portion 15*a*, which corresponds to and is opposite to the first portion 13*a*,
- a fourth portion 15*b*, which corresponds to and is opposite to the second portion 13*b*.

The first face 11 has a longitudinal first protrusion 19 which extends along the first axis X, from which two first spacers 20*a*, 20*b* rise.

The first protrusion 19 has an elevation of 2-4 mm, a length comparable to the size of the unit cell 10 along the first axis X, and a width of 8-12 mm.

In the present description:

- the term "elevation" means the dimension in the direction perpendicular to the plane of arrangement of the unit cell 10 and of the plate 1,
- the term "length" means the dimension along the axis of extension of the respective protrusion or spacer, perpendicular to the direction of the elevation,
- the term "width" means the dimension in the direction perpendicular both to the elevation and to the length.

These two first spacers 20*a*, 20*b* have, for example, an elevation of 3-6 mm, a length of 15-30 mm and a width of 5-12 mm.

The two first spacers 20*a*, 20*b*, are substantially mirror-symmetrical with respect to a plane of symmetry that is perpendicular to the first axis X and passes through a second axis Y of the unit cell 10, which is substantially central and parallel to the direction of the corrugation.

The first face 11 has two longitudinal end protrusions 21*a*, 21*b*, which extend in parallel to the first axis X, each one at a perimetric edge of the unit cell 10, respectively:

- a second protrusion 21*a*,
- a third protrusion 21*b*.

These two longitudinal end protrusions 21*a*, 21*b* have, for example, an elevation of 2-4 mm, a length comparable to the size of the unit cell 10 and a width of 8-12 mm.

Two second spacers 22*a*, 22*b* rise from this second protrusion 21*a* and are substantially mirror-symmetrical with respect to the plane of symmetry that is perpendicular to the first axis X and passes through the second axis Y.

These two second spacers 22*a*, 22*b* have, for example, an elevation of 3-6 mm, a length of 15-30 mm and a width of 5-12 mm.

Similarly, two third spacers 23*a*, 23*b* rise from this third protrusion 21*b* and are substantially mirror-symmetrical with respect to the plane of symmetry that is perpendicular to the first axis X and passes through the second axis Y.

These two third spacers 23*a*, 23*b* have, for example, an elevation of 3-6 mm, a length of 15-30 mm and a width of 5-12 mm.

The first portion 13*a* has two fourth protrusions 24*a*, 24*b*, which extend along a substantially central axis thereof which is parallel to the first axis X.

These two longitudinal fourth protrusions 24*a*, 24*b* have, for example, an elevation of 1-3 mm, a length of 20-30 mm and a width of 3-8 mm.

A fourth spacer 25*a*, 25*b* extends from each fourth protrusion 24*a*, 24*b*, at the respective perimetric edge of each unit cell 10 that is parallel to the second axis Y.

Each fourth spacer 25*a*, 25*b* has, for example, an elevation of 3-6 mm, a length of 10-20 mm and a width of 5-15 mm.

The second portion 13*b* has a longitudinal fifth protrusion 26, which extends along a substantially central axis thereof that is parallel to the first axis X.

This fifth protrusion 26 has, for example, an elevation of 1-3 mm, a length of 20-30 mm and a width of 3-8 mm.

A fifth spacer 27 rises from the fifth protrusion 26 in parallel to the first axis X and to the second axis Y.

This fifth spacer 27 has, for example, an elevation of 3-6 mm, a length of 10-20 mm and a width of 5-15 mm.

The third portion 15*a* has a sixth spacer 28 which extends along the second axis Y.

This sixth spacer 28 has, for example, an elevation of 3-8 mm, a length of 15-30 mm and a width of 5-15 mm.

The fourth portion 15*b* has two seventh spacers 29*a*, 29*b*, each one at a perimetric edge of the unit cell 10 that is parallel to the second axis Y.

These seventh spacers 29*a*, 29*b* have, for example, an elevation of 3-6 mm, a length of 15-30 mm and a width of 5-15 mm.

The protrusions 19, 21*a*, 21*b*, 24*a*, 24*b*, 26 are made in a single piece with the rest of the unit cell 10 and of the plate 1, during the molding of the latter and they define channels for the cold fluid to flow through, in the configuration for use.

These protrusions 19, 21*a*, 21*b*, 24*a*, 24*b*, 26 and these spacers 14, 16 are arranged so as to produce mutually perpendicular directions of flow on the two faces 11, 12.

At each protrusion 19, 21*a*, 21*b*, 24*a*, 24*b*, 26 of the first face 11 there is a complementary groove/shaped portion on the second face 12, not shown in the figures.

Each spacer that extends from a respective protrusion has an elevation that is higher than it, with respect to the corresponding face of the unit cell 10.

In particular:

all the spacers 14 of the first face 11 have the same elevation with respect thereto, all the spacers 16 of the second face 12 have the same elevation with respect to the latter.

The unit cell 10 has, furthermore, a surface shape that defines:

in the first portion 13*a* and the corresponding third portion 15*a*, a dome 100 with an elliptical profile, in the second portion 13*b* and the corresponding fourth portion 15*b*, two half-domes 100*a* and 100*b* with a semi-elliptical profile, which are mirror-symmetrical with respect to the second axis Y, respectively a first half-dome 100*a* and a second half-dome 100*b*.

In particular, the minor axis of the ellipse of the dome 100 is located at the sixth spacer 28 and the major axis of the ellipse extends between the fourth spacers 25*a*, 25*b*.

The dome 100 has a concavity directed toward the first face 11, a corresponding convexity directed toward the second face 12, with the peak at the sixth spacer 28.

In practice, the dome 100 defines a protrusion toward the second face 12.

The first half-dome 100*a* has:

the major half-axis at the fifth protrusion 26, extending between the seventh spacer 29*a* and the fifth spacer 27, the minor axis at the seventh spacer 29*a*.

The first half-dome 100*a* has a concavity directed toward the first face 11, a corresponding convexity directed toward the second face 12, with the peak at the seventh spacer 29*a*.

In practice, the first half-dome 100*a* defines a protrusion toward the 20 second face 12.

The second half-dome 100*b* has:

the major half-axis at the fifth protrusion 26, extending between the seventh spacer 29*b* and the fifth spacer 27, the minor axis at the seventh spacer 29*b*.

The second half-dome 100*b* has a concavity directed toward the first face 11, a corresponding convexity directed toward the second face 12, with the peak at the seventh spacer 29*b*.

In practice, the second half-dome 100*b* defines a protrusion toward the second face 12.

This dome 100 and these half-domes 100*a* and 100*b* provide projections in the order of 0.05-0.3 mm toward the second face 12, in contact with the hot fluid, and are adapted to partially compensate the deformation owing to the depression effect that occurs on the first face 11 in contact with the cold fluid.

Figure 2:
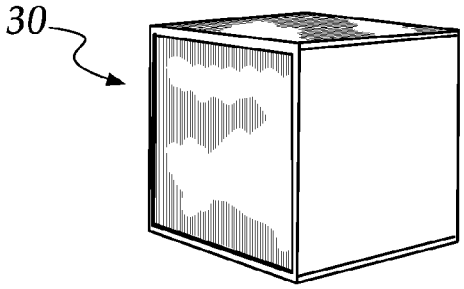
FIG. 2 is an overall perspective view of an exchanger according to the invention.

FIG. 2 shows a plate heat exchanger 30 according to the invention.

The exchanger 30 is of the air/air type.

Figure 3:
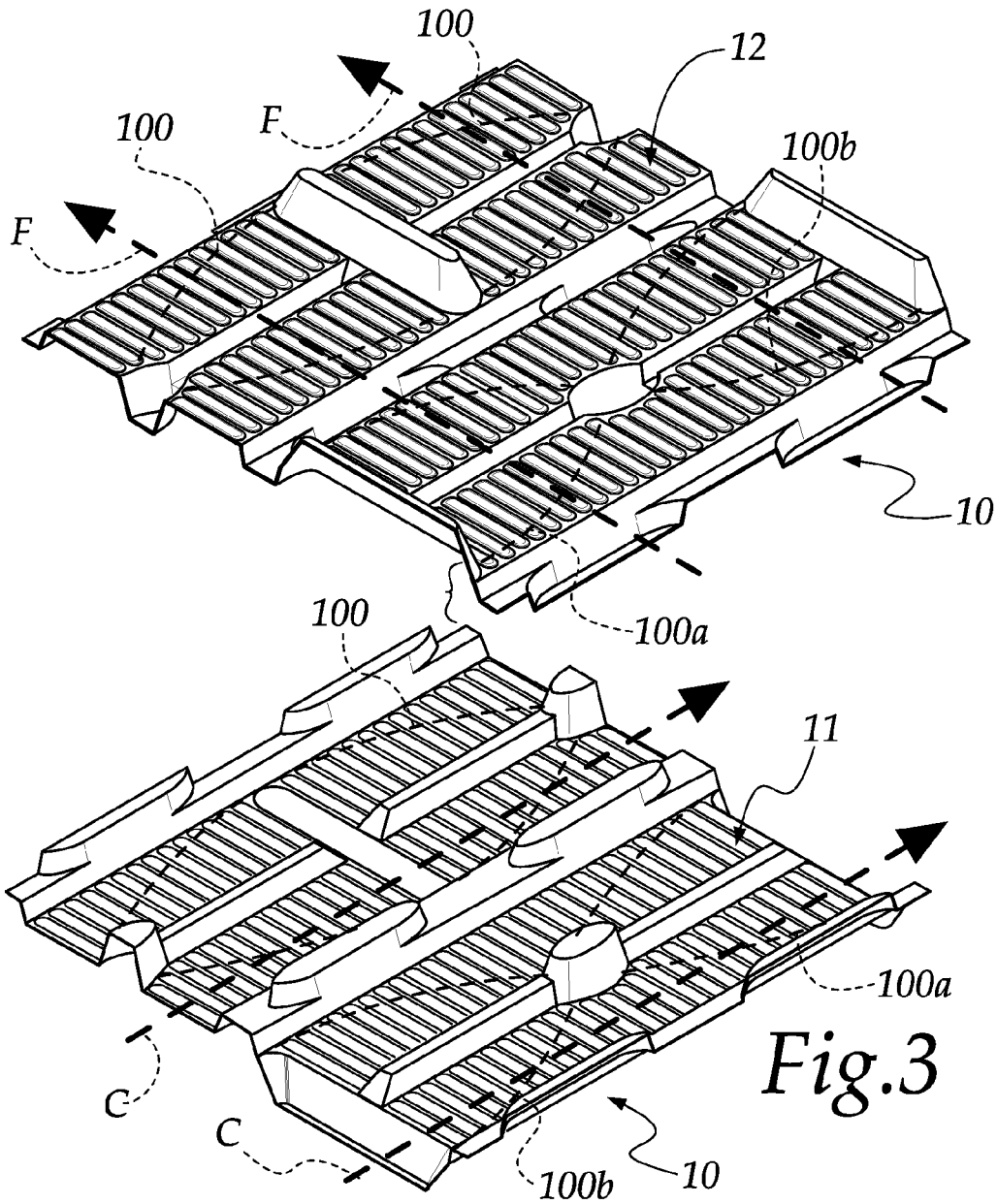
FIG. 3 is an exploded view of a portion of the exchanger of FIG. 2.
Figure 4:
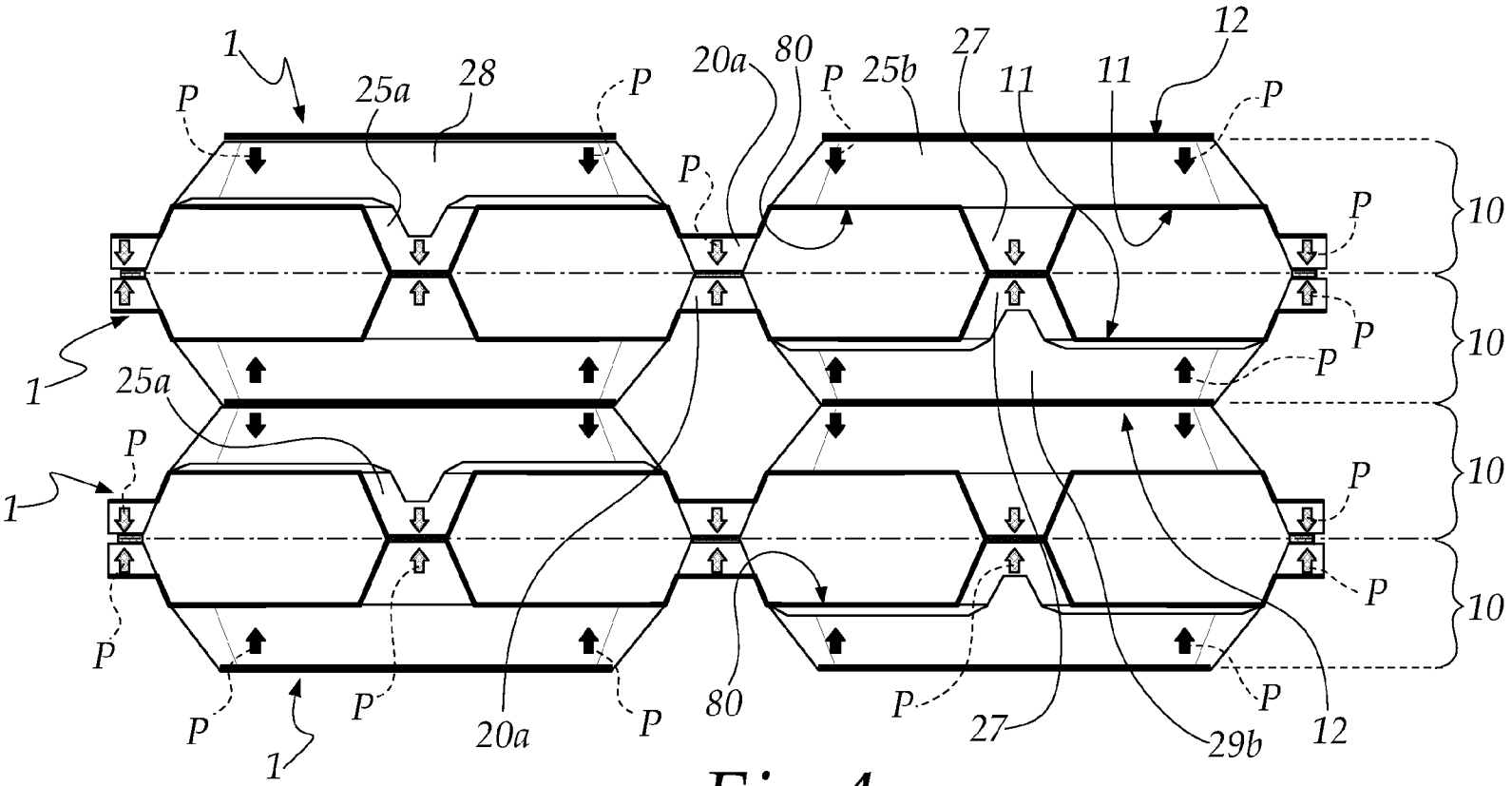
FIG. 4 is a cross-sectional side view of a portion of an exchanger according to the invention.

FIGS. 3 and 4 show a portion of an exploded view and a cross-sectional side view of an internal area of the exchanger 30.

In the correct coupling of the plates, two plates 1 are arranged in the same direction, mutually directed towards the same face 11, 12.

The coupling of the plates is obtained by rotating one plate on the other by 180°, in such a way that only the spacers 14, 16 and the corresponding edges of two successive plates are in contact.

Figure 5:
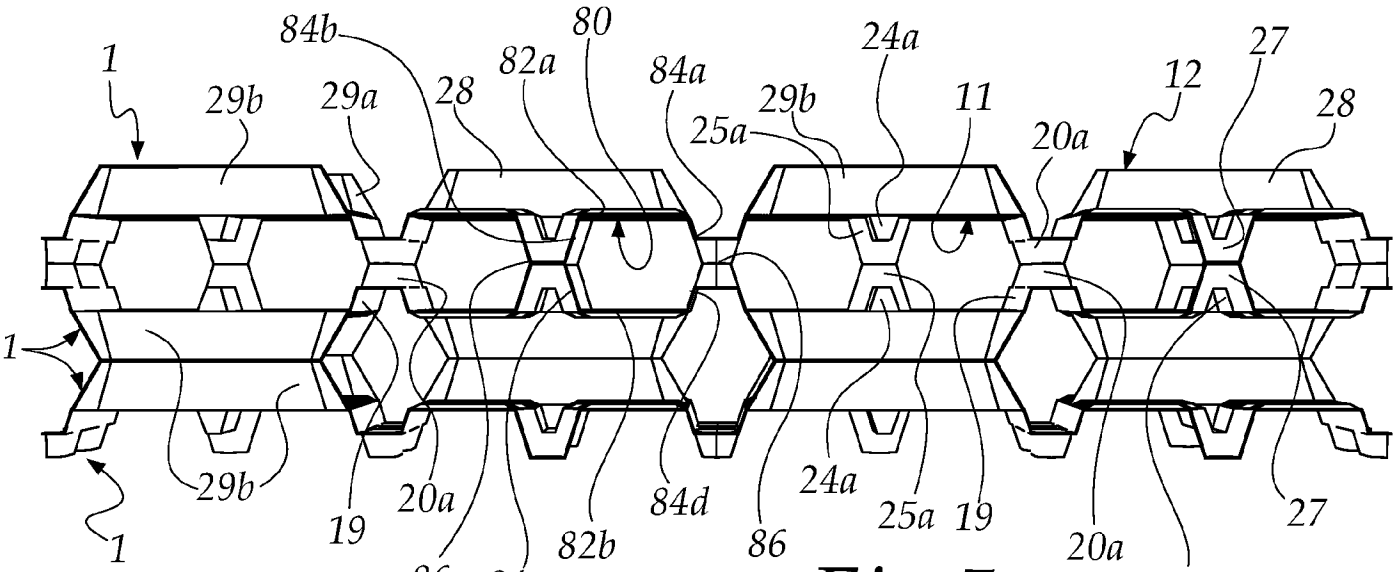
FIGS. 5 and 6 are two different perspective side views of a portion of a heat exchanger according to the invention.
Figure 6:
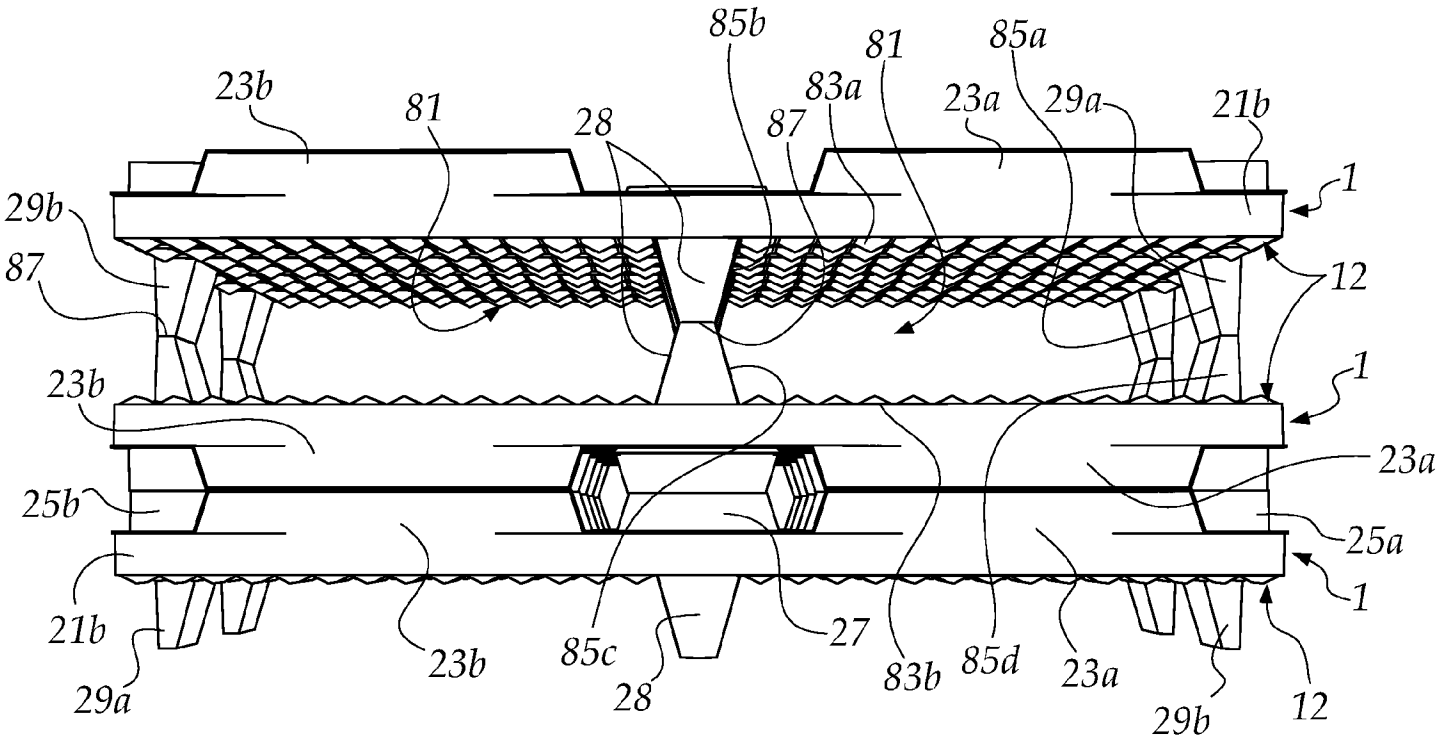

The results of the matching of the plates are shown in FIGS. 5 and 6.

FIG. 5 schematically shows the arrangement of the plates in the exchanger 30 and the resultant conduits seen from the cold side, where the process fluid is, while FIG. 6 schematically shows the arrangement of the plates in the exchanger 30 and the resultant conduits seen from the hot side, where the data center is.

The exchanger 30 has conduits 81 for the hot fluid and conduits 80 for the cold fluid, which are arranged on mutually parallel planes, in directions at 90° with respect to each other.

In particular, as becomes clear from FIGS. 4, 5 and 6, the conduits 80, 81 are hexagonal in cross-section as a result of coupling two successive plates 1 by facing the same face 11, 12 of them.

The hexagonal cross-section of the conduits 80, 81 has two mutually opposite elongated sides, respectively 82*a*, 82*b*, 83*a*, 83*b*, and the other four sides, respectively 84*a*, 84*b*, 84*c*, 84*d*, 85*a*, 85*b*, 85*c*, 85*d*, are inclined with respect to the preceding sides and are tapered toward the points 86, 87 of mutual support/contact between the two successive plates 1.

The exchanger 30 has a plurality of plates 1, as described above.

In particular, the plates 1 are coupled so as to mutually face the same face, first 11 or second 12, of the respective unit cells 10, and so that each spacer of the first face 11 of a unit cell 10 faces and is in contact with the corresponding spacer of the first face 11 of the next unit cell 10, and similarly with regard to the second face 12.

In practice, to assemble the exchanger 30 it is sufficient to arrange the plates 1 in series, rotating them mutually through 1800 with respect to their plane of arrangement.

FIG. 3 shows:

with the arrows C, substantially, the direction of travel of the cold fluid, with the arrows F, substantially, the direction of travel of the hot fluid.

In FIG. 4, the arrows P indicate the progression of the pressures on the various faces of the plates of the exchanger 30.

The first face 11, in contact with the cold side, is subjected to a negative pressure, while the second face 12, in contact with the hot side, is subjected to a positive pressure.

The tensions balance out at the point of contact and the displacement is therefore substantially nil, thus reducing the deformation of the plate.

From experimental tests and finite element calculations it has emerged that the arrangement and the number of spacers on the two faces makes it possible to reduce/eliminate the deformation of the plate owing to the pressure difference to which the two faces are subjected.

The spacers differ in terms of number, shape, size and functions between the cold side, where the process fluid is, and the hot side, where the data center is.

In particular, the cold side is the side in contact with the first faces 11 of the plates 1, while the hot side is the side in contact with the second faces 12 of the plates 1.

Such spacers are adapted mainly to:

separate the plates 1 so as to create conduits for the cold fluid, the process fluid, and for the hot fluid, the fluid of the data center, at right angles to each other, increase the mechanical properties on the cold side, where the process fluid is.

The conduits of the hot side, where the data center is, are subjected to a positive pressure, while the conduits of the cold side, where the process fluid is, are subjected to a negative pressure.

Therefore a differential pressure is generated, given by the sum of the absolute values of the positive and negative pressures between the conduits of the data center side, which tend to expand, and the conduits of the process fluid side, which tend to collapse, and this determines the pressure load that the single plate has to withstand.

The spacers on the hot side (the data center side) withstand a small part of the pressure load because the pressure differential tends to pull the individual spacers away from the corresponding spacers (traction effect).

The spacers on the cold side, the process fluid side, have to withstand the greater part of the pressure load because the pressure differential tends to push the individual spacers against the corresponding spacers (compression effect).

From a mechanical point of view, the total pressure load is symmetrical to the plane that lies on the contact surface of the spacers on the cold side (the process fluid side).

On this contact surface, the pressure load is completely discharged/balanced and the displacements are therefore equal to zero.

The spacers on the cold side (the process fluid side) therefore need to have a robust shape and structure and there needs to be a greater number of them than of the spacers on the hot side, in order to ensure an adequate structural rigidity of the plate and prevent deformations that would obstruct the path of the process fluid, thus compromising the operation of the exchanger.

Differently, the spacers on the hot side (data center) have a tapered shape and there is a smaller number of them, in order to reduce as far as possible the flow resistances on the hot side and since they have little influence on the rigidity of the structure of the plate during use.

In particular, the tapered shape and the smaller number of spacers on the hot side (second face 12) create small obstacles (or concentrated resistances) in the path of the fluid originating from the data center.

For example, looking at FIG. 1*a*, the tensional state that develops along the line R that passes through the spacers 14 of the cold side can be found in the following manner.

Consider the segment, along the line R, composed of: half-spacer 14, corresponding to the fourth spacer 25*a*, the fourth protrusion 24*a*, the sixth spacer 28 (hot side), the fourth protrusion 24*b* and half-spacer 14, corresponding to the fourth spacer 25*b*.

Figure 7:
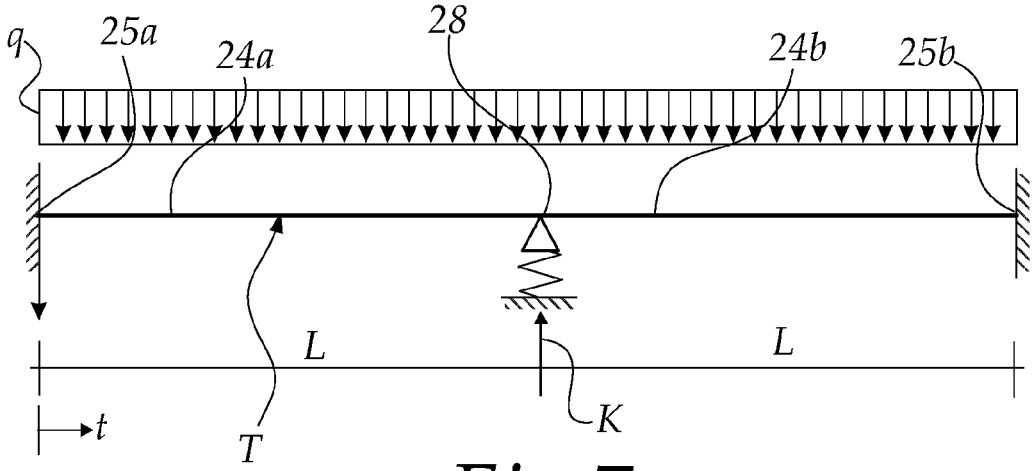
FIGS. 7, 8, and 9 schematically illustrate the distribution of the loads and the camber along a segment of a portion of the plate of FIG. 1.

This segment repeats periodically up to the ends of the plate 1, the effects of which are negligible, and can be shown schematically as in FIG. 7.

The fourth spacers 25*a* and 25*b* are shown schematically as coupled solidly, and they have the following boundary conditions:

vertical displacement substantially nil, contact between corresponding fourth spacers 25*a*, 25*b* of subsequent plates, horizontal displacement substantially nil, there being no load in that direction, angular displacement substantially nil, due to the periodicity with the preceding/next segment.

The sixth spacer 28 is shown schematically as coupled by resting contact and able to yield, and it has the following boundary conditions:

vertical movement allowed, yielding coupling, horizontal displacement substantially nil, there being no load in that direction, angular movement substantially nil, due to the symmetry of structure and load with respect to the midpoint of the plate.

The fourth protrusions 24*a*, 24*b* are overall shown schematically as a beam T having:

static moment of inertia (I),

Young's modulus (E), length (2L), which is subjected to:

a distributed load (q), constituted by the pressure differential acting on the plate, a concentrated load (k), constituted by the constraining reaction of the yielding coupling determined by the sixth spacer 28.

Figure 8:
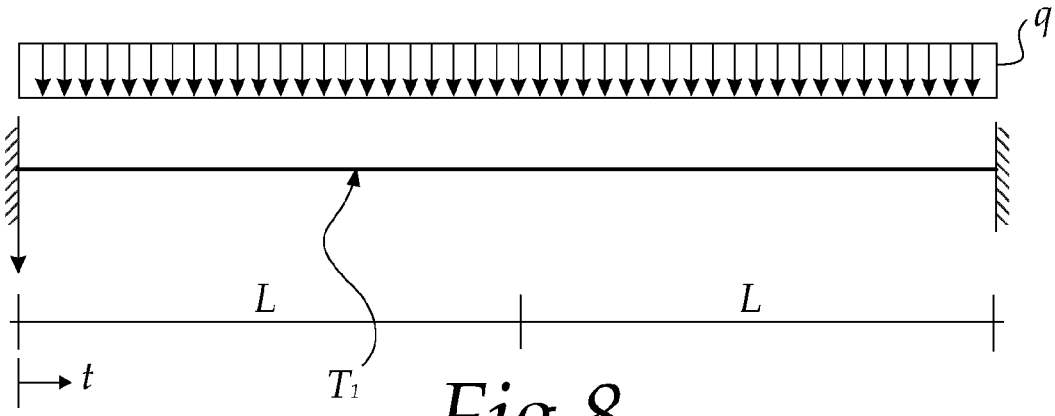
Figure 9:
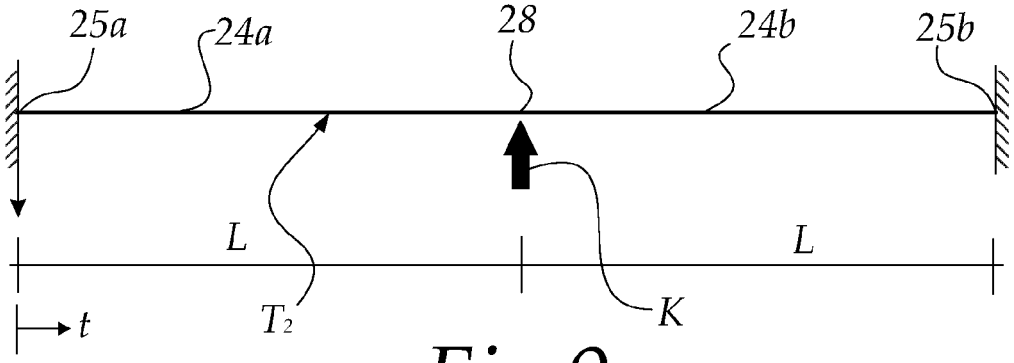

The tensional diagram in FIG. 7 can be broken down into two tensional sub-diagrams, shown in FIGS. 8 and 9, which when summed together give the overall tensional diagram.

The first sub-diagram, shown in FIG. 8, shows a beam T1 supported at both ends with a distributed load q.

Looking at FIG. 8, the beam T1 has:

a bending moment:

$$M = \frac{q}{17} \cdot (12Lt - 6t^2 - 4L^2)$$

which has its maximum at the midpoint (t=L), which is equal to:

$$M_{max} = \frac{qL^2}{6};$$

camber:

$$f = \frac{-qt^2}{24EI} \cdot (2L - t)^2,$$

with 0<t<2L, which has its maximum at the midpoint (t=L), which is equal to:

$$f_{max} = \frac{-q(2L)^4}{384\,EI}.$$

The second sub-diagram, shown in FIG. 9, shows a beam T2 supported at both ends with a concentrated load k at the midpoint.

Looking at FIG. 9, the beam T2 has:

a bending moment:

$$M = \frac{k}{8} \cdot (4t - 2L)$$

which has its maximum at the midpoint (t=L), equal to:

$$M_{max} = \frac{k2L}{8};$$

camber:

$$f = \frac{kt^2}{48\,EI} \cdot (6L - 4t),$$

with 0<t<L, which has its maximum at the midpoint (t=L), which is equal to:

$$f_{max} = \frac{+k(2L)^3}{192\,EI} = \frac{+kL^3}{24\,EI}.$$

The overall camber of the beam T of FIG. 7 is therefore (with 0<t<L):

$$f_{sys} = \frac{kt^2}{48\,EI} \cdot (6L - 4t) - \frac{qt^2}{24\,EI} \cdot (2L - t)^2$$

The case k=0 corresponds to the condition described in the first sub-diagram, shown in FIG. 8.

The case k=qL corresponds to the rigid resting support condition such that $f_{sys}=0$.

The case k<qL corresponds to the yielding coupling condition which schematically represents the sixth spacer 28 (hot side, the data center).

To minimize the overall camber $f_{sys}$ it is necessary to act on at least one of the parameters on which it depends: E, q, L or I:

- it is not possible to act on the Young's modulus (E), to increase it, since the material and its Young's modulus are a design parameter,
- it is not possible to reduce the extent of the distributed load q because that would limit the thermodynamic performance,
- it is possible to reduce the length L of the beam, but there must be an adequate compromise between thermodynamic performance and mechanical strength, since an excessive reduction of the length L produces a greater density per unit of surface area of the spacers 14, and therefore consequent localized flow resistances which impair the thermodynamic performance;
- it is possible to increase the static moment of inertia I, but there must be an adequate compromise between thermodynamic performance and mechanical strength, since an excessive variation of the cross-section would produce both a criticality at the technological/production level, due to the difficulty of implementation, and also an impairment in terms of thermodynamic performance.

A distribution of protrusions and spacers, as illustrated previously, makes it possible to obtain satisfactory thermodynamic performance, by optimizing the geometry and in particular the profile of the plate 1, thus increasing the static moment of inertia I, while at the same time ensuring sufficient mechanical strength.

Considering the cross-section of the plate taken along the segment Q, with reference to FIGS. 10 and 11, below the contribution of the static moment of inertia I is shown and the difference is analyzed between the typical profile of a flat plate, represented as a flat beam in FIG. 10, and the optimized profile, represented as a beam with an omega-shaped cross-section in FIG. 11, as in the case of the segment Q of the plate according to the present invention.

The objective is to highlight the benefits introduced by the optimized profile on the geometry of a plate according to the invention.

For convenience, the effect of the corrugation is ignored.

Figure 10:
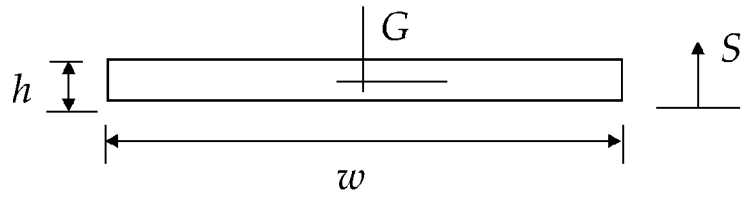
FIGS. 10 and 11 show two beam cross-sections.

Taking, for the purposes of example, the beam with flat cross-section shown in FIG. 10, with:

- width w=30 mm,
- thickness h=0.3 mm
- the static moment of inertia I of the flat cross-section with respect to its center of gravity G is:

$$I = \frac{1}{12} wh^3 = 0.0675\ \text{mm}^4,$$

considering the center of gravity G at a height $$s_G = \frac{h}{2}$$

with respect to the lower side of the cross-section.

To increase the static moment of inertia I, we can act on the parameters w and h.

However, an increase of the width w would result in an increase of the surface of the plate with consequent increase of the distributed load that acts on it, while a reduction of the width would result in a decrease of the static moment of inertia, a reduction of the surface of the plate, and therefore a reduction of the distributed load that acts on the plate.

As a consequence, the choice of the width w must be a compromise in order to obtain sufficient thermodynamic performance.

An increase in the thickness h on the other hand would result in using more plastic material to make the plate, and as a consequence it would result in an increase in cost.

The thickness h is furthermore an essential parameter from the point of view of production for the manufacture of the plate.

The minimum thickness h that allows a successful process of thermoforming the plate must therefore be chosen.

Figure 11:
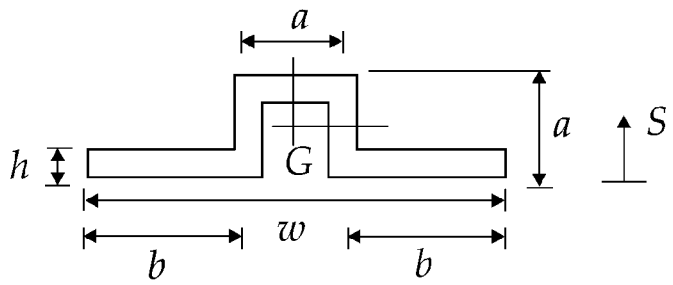

Taking instead, again for the purposes of example, the beam with an omega-shaped cross-section shown in FIG. 11, with:

width w=30 mm thickness h=0.3 mm first characteristic dimension a=2 mm second characteristic dimension b=14 mm the static moment of inertia I of the omega-shaped cross-section with respect to its center of gravity G is:

$$I = a^2\left[\frac{a^2}{12} + \left(\frac{a}{2} - s_G\right)^2\right] - (a-2h)(a-h)\left[\frac{(a-h)^2}{12} + \left(\frac{a-h}{2} - s_G\right)^2\right] + 2bh\left[\frac{h^2}{12} + \left(s_G - \frac{h}{2}\right)^2\right] = 2.6568 \text{ mm}^4$$

considering the center of gravity G at a height approximately equal to $$s_G = \frac{2a^2}{3a + 2b}$$

with respect to the lower side of the cross-section.

As can be seen, the introduction of the omega-shaped cross-section in place of the flat cross-section produces an appreciable increase in the static moment of inertia I, for the same width w and thickness h.

Using CFD (Computational Fluid Dynamics) simulations, it has been verified that the geometry thus proposed enables satisfactory heat exchange conditions.

Furthermore, the particular arrangement of the spacers, the dimensions, the shape and the number of them makes it possible to limit the deformation of the unit cell 10 and its warping toward the cold side.

Figure 12:
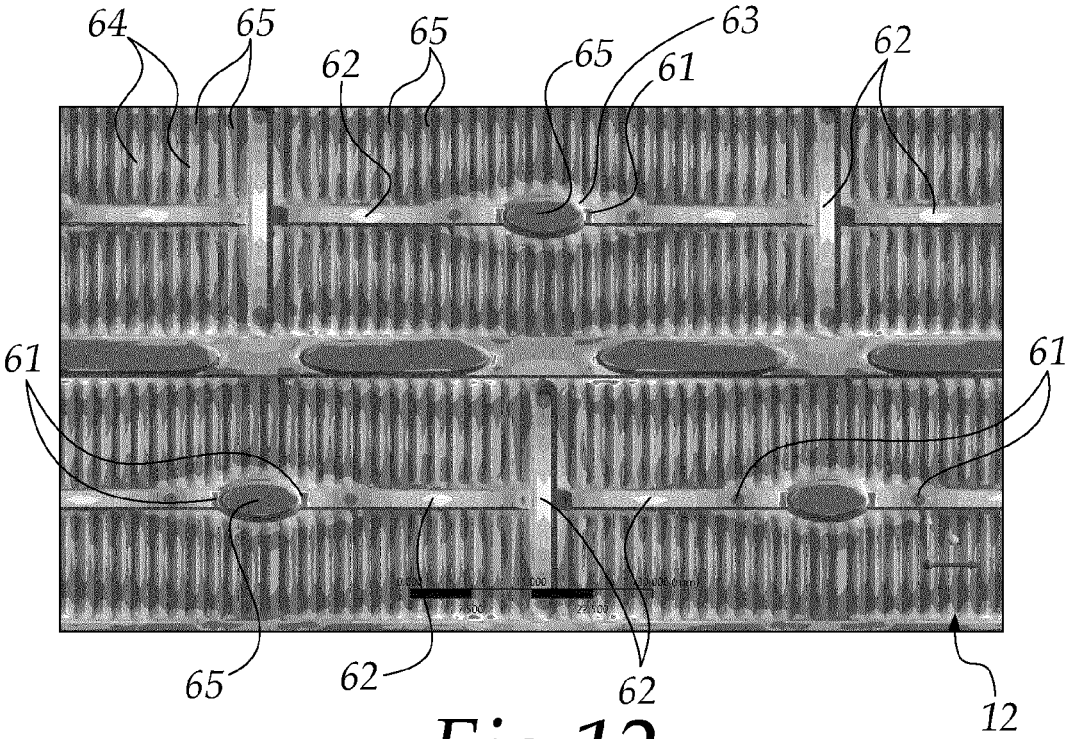
FIG. 12 graphically shows the results of a finite element simulation of the distribution of tensions on a plate according to the invention during operation.
Figure 13:
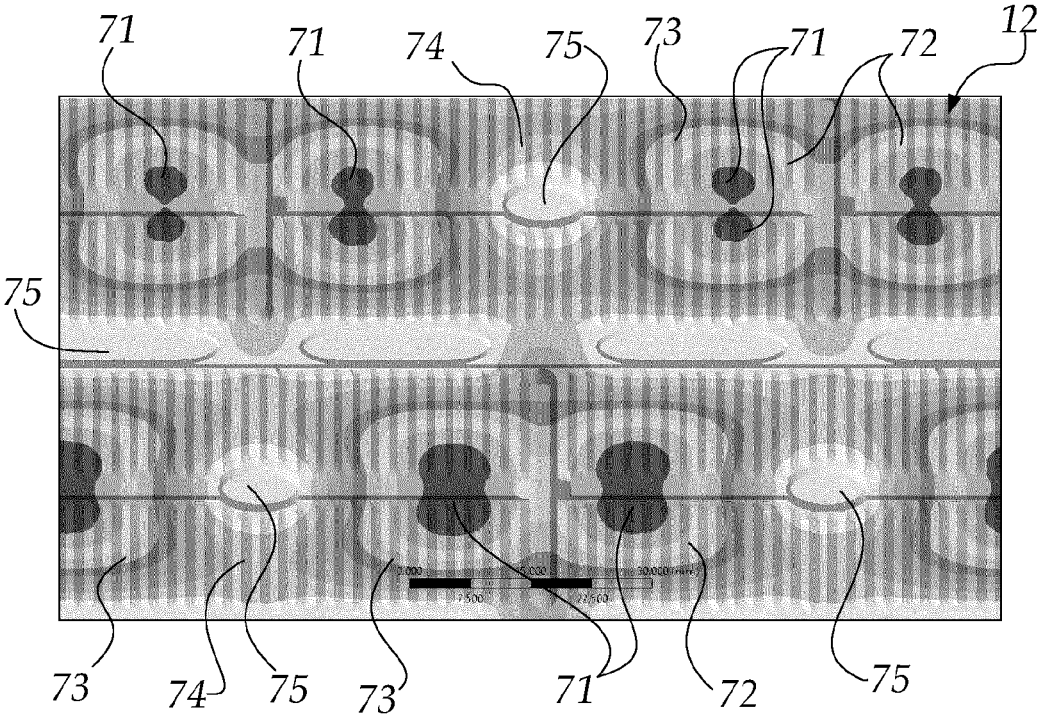
FIG. 13 graphically shows the results of a finite element simulation of the deformations of a plate according to the invention during operation.

FIGS. 12 and 13 graphically show, for the purposes of example, the results of two finite element simulations on a portion of plate 1, with a thickness of 0.3 mm, on the side of the second faces 12, subjected under operating conditions to a pressure of 3000 Pa.

In the simulations, a Young's modulus of the material was set as E=2250 MPa and a Poisson's ratio was set as v=0.34.

FIG. 12 graphically shows the distribution of the tensions according to the Von Mises yield criterion on a portion of plate, where:

the zones indicated with 65 are zones where the tension is nil, the zones indicated with 64 are zones with a tension of 1 MPa, the zones indicated with 62 are zones with a tension of 2 MPa, the zones indicated with 63 are zones with a tension of 3.1 MPa, the zones indicated with 61 are the zones where the tension is maximum and is equal to 4.7 MPa, at the longitudinal ends of the spacers, which in turn are surrounded by zones 63.

FIG. 13 graphically shows the results of a finite element simulation of the deformations of a plate according to the invention during operation, on a portion of plate, where:

the zones indicated with 71 are zones where the displacement is maximum and is equal to 0.11 mm, the zones indicated with 72 are zones where the displacement is equal to 0.07 mm, the zones indicated with 73 are zones where the displacement is equal to 0.04 mm, the zones indicated with 74 are zones where the displacement is equal to 0.009 mm, the zones indicated with 75 are zones with negative displacement, equal to −0.0025 mm.

It should be noted that a plate according to the invention favors low flow resistances on the hot side in overpressure over plates in a partial vacuum, in order to obtain an improvement in energy consumption.

Also, by virtue of the symmetry of the points of contact of the side in a partial vacuum between the plates, the tensions balance out at the point of contact. This results in a displacement and therefore a reduction in the deformation of the plate.

In practice it has been found that the invention fully achieves the intended aim and objects by providing a plate for a heat exchanger wherein the pressure difference between the hot side and the cold side does not result in a deformation thereof, and/or results in a minor deformation, even if the plate is made of materials with a low Young's modulus.

With the invention a plate for a heat exchanger has been devised that is made of materials with a low Young's modulus, which makes it possible to obtain better yields by way of containment of flow resistances compared to similar, conventional plates.

Furthermore, with the invention a heat exchanger has been provided with a plate that is capable of achieving the above-mentioned objects.

The invention thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The invention claimed is:

1. A plate for a heat exchanger, which comprises;

a plurality of unit cells, each one of said plurality of unit cells comprising a first face and a second face which is opposite said first face, said first face and said second face having a plurality of spacers which are arranged so as to produce mutually perpendicular directions of flow between said first face and said second face, wherein each of said plurality of unit cells has a quadranqular profile, wherein said first face and said second face have a corrugation, wherein a first axis of each one of said plurality of unit cells is substantially central and perpendicular to a direction of said corrugation, wherein a second axis of each of said plurality of unit cells is substantially central and parallel to the direction of said corrugation;

wherein said first face comprises two portions, wherein said two portions of said first face comprise:

a first portion; and a second portion, wherein said second face comprises two additional portions, wherein said two additional portions of said second face comprise:

a third portion, which corresponds to and is opposite said first portion of said first face; and a fourth portion, which corresponds to and is opposite said second portion of said first face, said plurality of spacers differing between said first face and said second face in terms of at least one of number, shape, or size, wherein said first face has two or more longitudinal end protrusions, which extend parallel to said first axis, each one at a perimetric edge of each one of said plurality of unit cells, wherein each of said two or more longitudinal end protrusions include two or more longitudinal end spacers of said plurality of spacers rising from said two or more longitudinal end protrusions and being substantially mirror-symmetrical with respect to a plane of symmetry that is perpendicular to said first axis and passes through said second axis.

2. The plate according to claim 1, wherein said plate is made of a material with a low Young's modulus.

3. The plate according to claim 1, wherein said plate is made of plastic material, wherein said plastic material includes at least one of:

polyvinyl chloride (PVC), polypropylene (PP), or polyethylene (PET).

4. The plate according to claim 2, wherein said plate is made of a material with a Young's modulus substantially comprised between 1000 MPa and 3000 MPa.

5. The plate according to claim 2, wherein each one of said plurality of spacers has an elevation at right angles to a plane of the first face or the second face and is made in a single piece with a rest of said plate.

6. The plate according to claim 1, wherein:

at each one of said plurality of spacers of said first face there is a complementary cavity/shaped portion on said second face, at each one of said plurality of spacers of said second face there is a complementary cavity/shaped portion on said first face.

7. The plate according to claim 1, wherein said first face has a longitudinal first protrusion which extends along said first axis, two first spacers rising from said longitudinal first protrusion, said two first spacers being substantially mirror-symmetrical with respect to a plane of symmetry that is perpendicular to said first axis and which passes through a second axis of each one of said plurality of unit cells, which is substantially central and parallel to the direction of said corrugation.

8. The plate according to claim 1, wherein said two or more longitudinal end protrusions comprise:

a second protrusion, two second spacers of said two or more longitudinal end spacers rising from said second protrusion and being substantially mirror-symmetrical with respect to said plane of symmetry that is perpendicular to said first axis and passes through said second axis, a third protrusion, two third spacers of said two or more longitudinal end spacers rising from said third protrusion and being substantially mirror-symmetrical with respect to said plane of symmetry that is perpendicular to said first axis and passes through said second axis.

9. The plate according to claim 8, wherein said first portion has two fourth protrusions, each one of which extends along a substantially central axis thereof, which is parallel to said first axis, a fourth spacer of said plurality of spacers extending from each one of said two fourth protrusions at the perimetric edge of each one of said plurality of unit cells that is parallel to said second axis.

10. The plate according to claim 9, wherein said second portion has a longitudinal fifth protrusion, which extends along a substantially central axis thereof that is parallel to said first axis, a fifth spacer of said plurality of spacers rising from said longitudinal fifth protrusion at said second axis.

11. The plate according to claim 9, wherein said third portion has a sixth spacer of said plurality of spacers which extends along said second axis.

12. The plate according to claim 11, wherein said fourth portion has two seventh spacers of said plurality of spacers, each one at a perimetric edge of each one of said plurality of unit cells that is parallel to said second axis.

13. The plate according to claim 8, wherein said protrusions are provided in a single piece with the rest of said plurality of plates.

14. The plate according to claim 8, wherein at each protrusion of said first face there is a complementary groove/shaped portion on said second face.

15. The plate according to claim 1, wherein:

the plurality of spacers of said first face have the same elevation with respect to said first face, the plurality of spacers of said second face have the same elevation with respect to said second face.

16. The plate according to claim 1, wherein each one of said plurality of unit cells has a surface shape that defines:

in said first portion and said third portion, a dome with an elliptical profile, in said second portion and said fourth portion, two half-domes with a semi-elliptical profile, which are mirror-symmetrical with respect to a second axis, said dome and said two half-domes providing projections toward said second face.

17. A heat exchanger of a plate type comprising:

a plurality of plates, each one of said plurality of plates comprising:

a plurality of unit cells, each one of said plurality of unit cells comprising a first face and a second face which is opposite said first face, said first face and said second face having a plurality of spacers which are arranged so as to produce mutually perpendicular directions of flow between said first face and said second face, wherein each of said plurality of unit cells has a quadranqular profile, wherein said first face and said second face have a corrugation, wherein a first axis of each one of said plurality of unit cells is substantially central and perpendicular to a direction of said corrugation, wherein a second axis of each of said plurality of unit cells is substantially central and parallel to the direction of said corrugation;

wherein said first face comprises two portions, wherein said two portions of said first face comprise:

a first portion; and a second portion, wherein said second face comprises two additional portions, wherein said two additional portions of said second face comprise:

a third portion, which corresponds to and is opposite said first portion of said first face; and a fourth portion, which corresponds to and is opposite said second portion of said first face, said plurality of spacers differing between said first face and said second face in terms of at least one of number, shape, or size, wherein said first face has two or more longitudinal end protrusions, which extend parallel to said first axis, each one at a perimetric edge of each one of said plurality of unit cells, wherein each of said two or more longitudinal end protrusions include two or more longitudinal end spacers of said plurality of spacers rising from said two or more longitudinal end protrusions and being substantially mirror-symmetrical with respect to a plane of symmetry that is perpendicular to said first axis and passes through said second axis.

18. The heat exchanger according to claim 17, wherein said plurality of plates are coupled so as to mutually face the same first face or the same second face of the respective unit cells, and so that:

at least one of:

each spacer of said first face of a unit cell faces and is in contact with the corresponding spacer of said first face of a next unit cell; or each spacer of said second face of a unit cell faces and is in contact with the corresponding spacer of said second face of the next unit cell.

19. The heat exchanger according to claim 17, wherein said plurality of plates are arranged mutually rotated by 180° with respect a plane of arrangement thereof.

20. The heat exchanger according to claim 19, wherein a coupling between said plurality of plates is obtained in such a way that only said plurality of spacers and corresponding edges of two successive plates are in contact.

21. The heat exchanger according to claim 17, further comprising:

conduits for a hot fluid and conduits for a cold fluid, which are arranged on mutually parallel planes, in directions at 90° with respected to each other.

22. The heat exchanger according to claim 21, wherein said conduits are hexagonal in cross-section as a result of coupling two successive of said plurality of plates by being directed toward the same face of them.

23. The heat exchanger according to claim 22, wherein said hexagonal cross-section of said conduits has two mutually opposite elongated sides and the other four sides are inclined with respect to preceding sides and are tapered toward points of mutual support/contact between two successive ones of said plurality of plates.

* * * * *